US007703645B2

(12) United States Patent
Moskun

(10) Patent No.: US 7,703,645 B2
(45) Date of Patent: Apr. 27, 2010

(54) BACKPACK ADAPTER

(75) Inventor: Peter Moskun, Baie d'Urfe (CA)

(73) Assignee: Ansul Canada Limited, Toronto, Ontario (CA)

( * ) Notice: Subject to any disclaimer, the term of this patent is extended or adjusted under 35 U.S.C. 154(b) by 516 days.

(21) Appl. No.: 10/831,967

(22) Filed: Apr. 26, 2004

(65) Prior Publication Data

US 2005/0000993 A1 Jan. 6, 2005

(30) Foreign Application Priority Data

Apr. 25, 2003 (CA) ..... 2426927

(51) Int. Cl.
*A45F 3/04* (2006.01)

(52) U.S. Cl. ..... 224/581; 224/579; 224/631; 224/637

(58) Field of Classification Search ..... 224/576, 224/628, 631, 155, 261, 633, 634, 907, 578, 224/579, 637, 581; 15/327.5; 417/234
See application file for complete search history.

(56) References Cited

U.S. PATENT DOCUMENTS

| | | | | | |
|---|---|---|---|---|---|
| 2,563,195 | A | * | 8/1951 | Soule et al. | 144/104 |
| 2,566,464 | A | * | 9/1951 | Redenback | 144/104 |
| 2,925,205 | A | | 2/1960 | Hunt | |
| 3,127,077 | A | | 3/1964 | Faro | |
| 3,219,243 | A | | 11/1965 | Mack | |
| 3,540,123 | A | * | 11/1970 | Yamada | 30/388 |
| 3,659,760 | A | * | 5/1972 | Blood | 224/157 |
| 3,690,525 | A | * | 9/1972 | Koons et al. | 224/155 |
| 4,310,110 | A | * | 1/1982 | Dexter | 224/246 |
| 4,558,808 | A | | 12/1985 | Fullmer | |
| 4,600,129 | A | * | 7/1986 | Kondo | 222/175 |
| 4,651,903 | A | * | 3/1987 | Pagliai | 222/175 |
| 4,658,778 | A | * | 4/1987 | Gamoh et al. | 123/195 C |
| 4,790,460 | A | * | 12/1988 | Harper, Jr. | 224/644 |
| 4,836,938 | A | * | 6/1989 | Kobasic | 224/155 |
| 4,934,573 | A | * | 6/1990 | Jaeger | 224/628 |
| 5,011,058 | A | * | 4/1991 | Sapp et al. | 224/261 |

(Continued)

FOREIGN PATENT DOCUMENTS

EP 0 887 005 A1 12/1998

(Continued)

*Primary Examiner*—Nathan J Newhouse
*Assistant Examiner*—Justin M Larson
(74) *Attorney, Agent, or Firm*—Brinks Hofer Gilson & Lione

(57) ABSTRACT

A backpack adapter comprising a generally L-shaped frame having a user side and a load side. The user side is provided with at least two coupling means for coupling a shoulder strap means thereon, the coupling means being spaced apart from each other. The L-shaped frame comprises a top L portion and a bottom L portion and the shoulder strap assembly is placed on either coupling means in order to either have the bottom L portion closer to the ground than the top L portion or reversibly have the top L portion positioned closer to the ground. The adapter can be used in at least two significantly different configurations: one by which the bottom L portion is used to carry a load on an upper side of said bottom L portion, the other by which the bottom L portion is used as a rack from which objects are hung.

8 Claims, 9 Drawing Sheets

U.S. PATENT DOCUMENTS 5,133,300 A * 7/1992 Miura ..... 123/2
5,176,303 A * 1/1993 Franke ..... 224/261
5,178,312 A * 1/1993 Iida ..... 224/261
5,492,255 A * 2/1996 Gansky et al. ..... 224/153
5,732,867 A 3/1998 Perkins et al.
5,829,874 A * 11/1998 Breeding ..... 366/120
5,868,462 A 2/1999 Truax
6,006,400 A * 12/1999 Presenza ..... 15/327.5
6,047,668 A * 4/2000 Yamamoto et al. ..... 123/2
6,053,259 A * 4/2000 Kojima et al. ..... 173/30
6,370,729 B2 * 4/2002 Miyamoto ..... 15/326
6,460,746 B1 * 10/2002 Amram ..... 224/579
6,464,118 B2 10/2002 McUmber
6,493,944 B2 * 12/2002 Jarzombek ..... 30/275.4
6,561,395 B2 * 5/2003 Lim et al. ..... 224/261
6,651,853 B2 * 11/2003 Higgins et al. ..... 224/155
6,832,711 B2 * 12/2004 Black ..... 224/628
7,021,508 B1 * 4/2006 Aston ..... 224/628
2002/0174511 A1 * 11/2002 Iida et al. ..... 15/405

FOREIGN PATENT DOCUMENTS

FR 1 377 401 A 11/1964
WO WO 00/74517 A1 12/2000

* cited by examiner

BACKPACK ADAPTER

FIELD OF THE INVENTION

The present invention relates to a backpack adapter.

BACKGROUND OF THE INVENTION

Backpacks are well known in the art and generally comprise a frame upon which fixed straps are placed so that a user can carry the backpack on his or her shoulders. Some backpacks are further provided with a waist strap to solidify the backpack on the person's back. However, one of the problems with these backpacks is that the straps are not longitudinally adjustable. Another problem is that such backpacks are generally not very versatile, since they can only be used in the configuration in which they were designed.

Several examples of backpack frames or adapters exist in prior art including those for use by fire fighters. U.S. Pat. No. 4,685,601 discloses a backpack adapter for carrying fire hoses and associated equipment, such as an air tank. The backpack adapter described therein has a vertical spine and a horizontal cross arm at each end of the spine, spring clips attached to the spine for releasable attachment to an air cylinder and belt fasteners to hold the fire hose unto the backpack, a seat for engaging the bottom of the air cylinder and a handle for manually lifting the backpack.

Similarly, U.S. Pat. No. 4,327,851 discloses a backpack harness assembly where a bottle or a cylinder of gas is to be carried on the back of a user such as a fire fighter. This backpack assembly has a carrier for the cylinder or other load which is hinged in the region of the user's shoulder blades to a back plate. The back plate extends down the back of the user and is hinged at the lumbar region to the frame of a pelvic girdle. According to the specification, such a backpack assembly allows a considerable degree of freedom of movement to the user.

Other types of backpack frames or adapters of more general use include U.S. Pat. No. 3,219,243 which describes a backpack frame which provides both comfort and security to any user because it is presumably immediately adjustable and convertible to custom fit the figures and individual body structure of the user as well as the specific requirements of the material to be carried.

U.S. Pat. No. 4,558,808 discloses a backpack assembly adapted to carry a power chain saw. This backpack assembly presents a shelf life configuration which houses the saw.

U.S. Pat. No. 6,464,118 describes a back supporter load-carrying mechanism. Such mechanism includes a pivotally bonded support element to allow for an even distribution of cargo weight to the lower back of the user, thus eliminating stress to the neck and upper back areas of the user.

However, none of the above inventions and patents, taken either singularly or in combination, is seen to disclose a backpack adapter which is versatile in terms of the different configurations in which it can be used and adjusted as will be subsequently described and claimed in the present invention.

SUMMARY OF THE INVENTION

It is an object of the invention to provide a backpack adapter which results in an assembly which is more fully adjustable and more versatile with respect to different user requirements. In accordance with the invention, this object is achieved with a backpack adapter comprising a generally L-shaped frame having a user side and a load side. The user side is provided with at least two coupling means for coupling a shoulder strap means thereon, the coupling means being spaced apart from each other.

The L-shaped frame comprises a top L portion and a bottom L portion and the shoulder strap means is placed on either coupling means in order to either have the bottom L portion closer to the ground than the top L portion or reversibly have the top L portion positioned closer to the ground than the bottom L portion. The backpack adapter can therefore be used in at least two significantly different configurations: one by which the bottom L portion is used to carry a load on an upper side of said bottom L portion, and the other by which the bottom L portion is used more as a rack from which objects to be carried are hung.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

Figure 1:
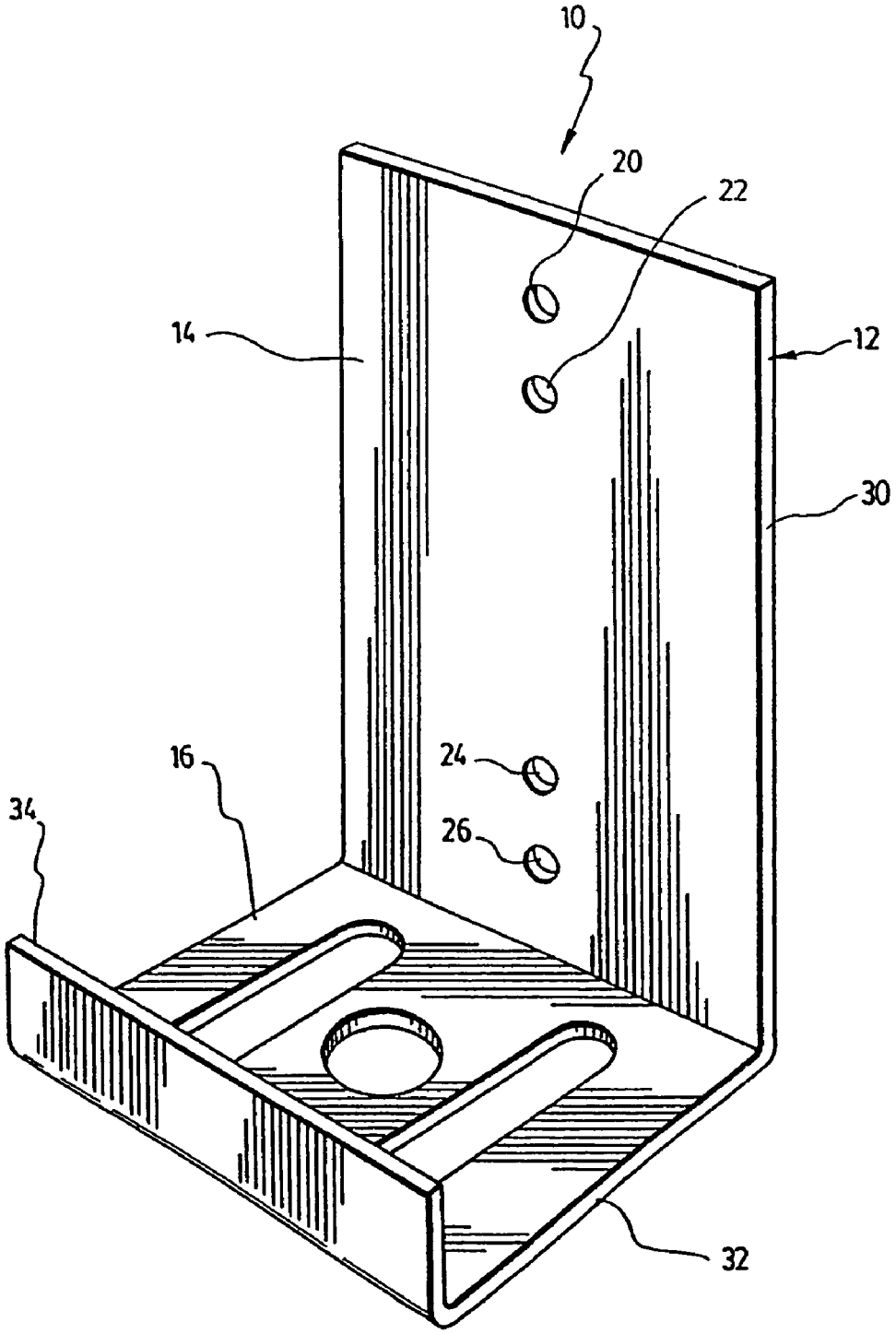
FIG. 1 is a schematic representation of the L-shaped backpack assembly.

In a preferred embodiment of the invention and referring to FIG. 1, the backpack adapter (10) comprises a generally L-shaped frame (12) having a user side (14) and a load side (16). The backpack adapter (10) includes four coupling means (20, 22, 24, 26) on the user side (14): two (20, 22) towards a first end of the frame and two (24, 26) towards the other end. The L-shaped frame (12) comprises a top L portion (30) and a bottom L portion (32). A shoulder strap means (66) can be placed on either coupling means (20, 22, 24, 26) in order to either have the bottom L portion (32) closer to the ground than the top L portion (30) or reversibly have the top L portion (30) positioned closer to the ground than the bottom L portion (32), as will be more fully explained hereinafter.

The load side (16) is preferably L-shaped, but can be even more preferably J-shaped, in that the bottom L portion (32) has a slight flange (34) extending at an angle therefrom.

Figure 8:
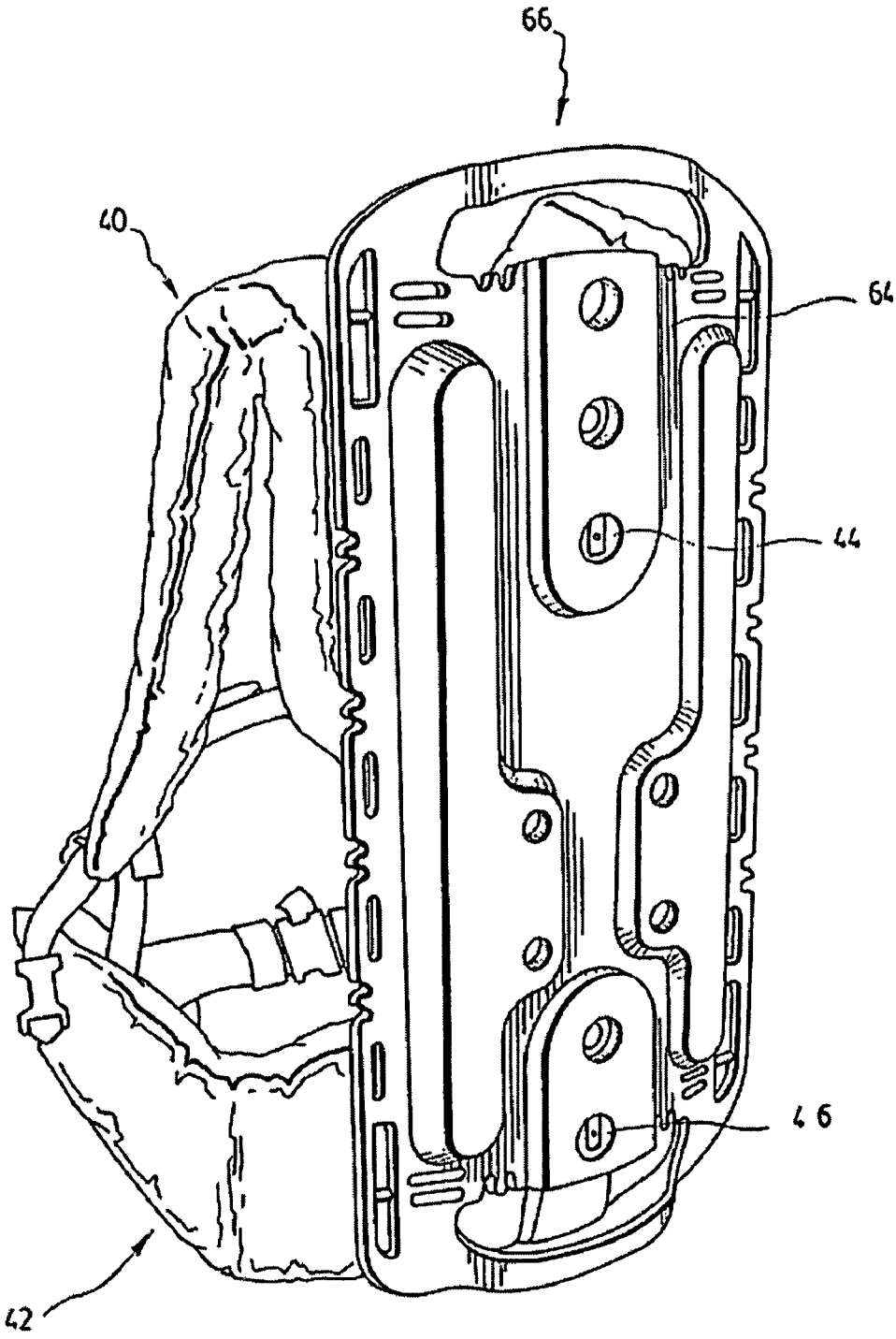
FIG. 8 is a schematic representation of the shoulder strap means shown in FIG. 7 including the shoulder strap assembly and the backboard.

On the user side (14), there is provided at least two and preferably four coupling means for receiving a shoulder strap means (66) thereon, and preferably a waist strap means (42), also. Both strap means (66 and 42) as shown in FIGS. 2A, 2B and 8 preferably include an interlocking feature, such as a quarter-turn coupling mechanism (44 and 46), to quickly couple each strap means to one of the coupling means (20, 22, 24, 26) on the user side (14) of the backpack adapter (10).

Figure 2A:
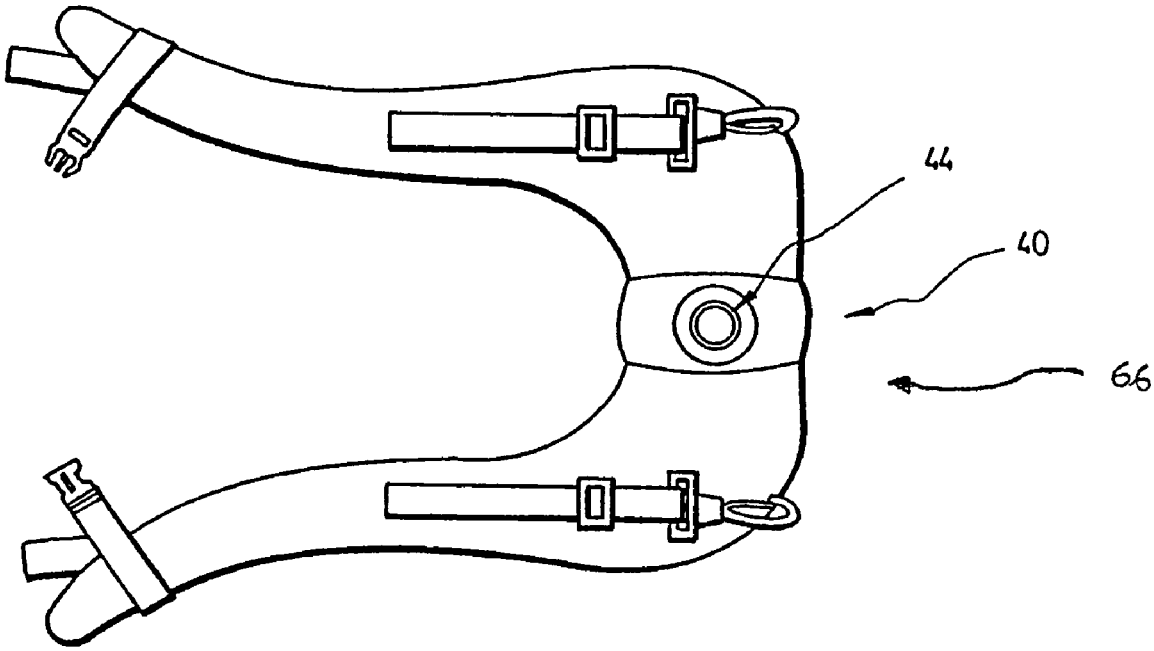
FIG. 2A is a schematic representation of the shoulder strap assembly.
Figure 2B:
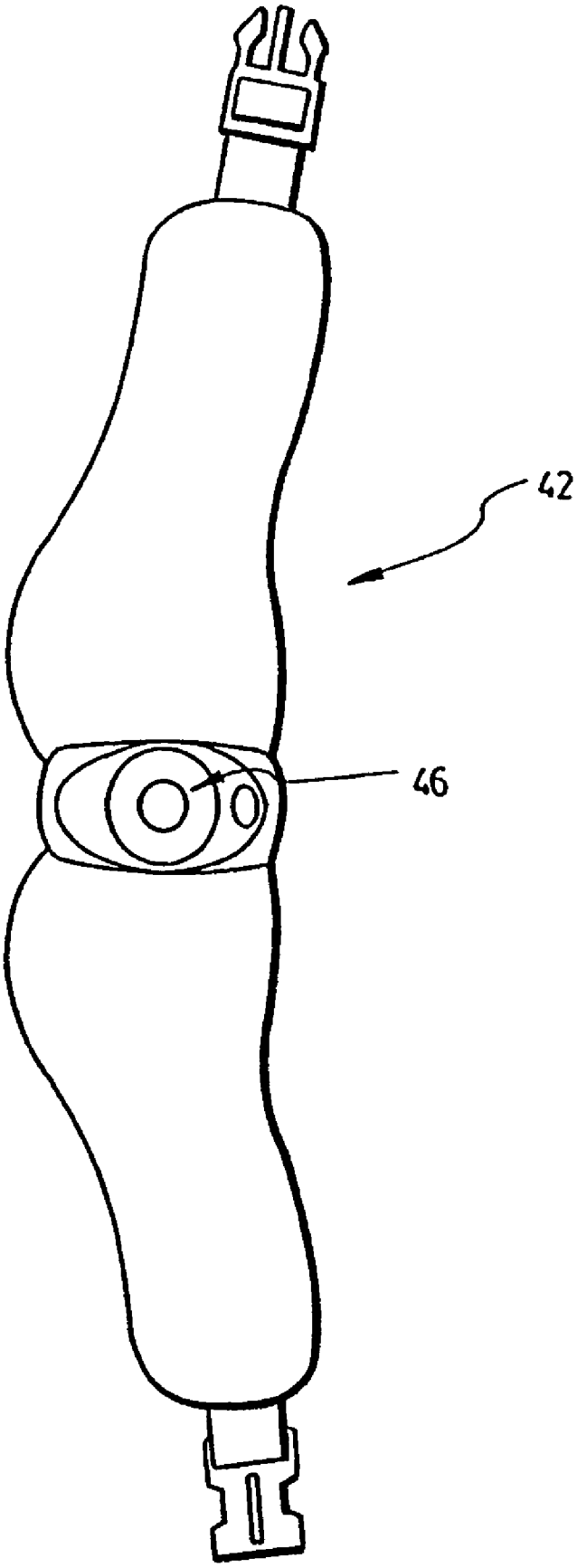
FIG. 2B is a schematic representation of the waist strap assembly.

In a preferred embodiment of the invention, the shoulder strap means (66) comprises a shoulder strap assembly (40) only, as shown in FIG. 2A. In another preferred embodiment of the invention, the shoulder strap means (66) comprises a shoulder strap assembly (40) and a backboard (64), as shown in FIG. 8. In the latter case, the interlocking feature that links the shoulder strap means (66) to the user side (14) of the backpack adapter (10) is located on the backboard (64).

It will thus be appreciated by a person skilled in the art that the shoulder strap means (66) can be placed on the coupling means (20, 22) located towards one end of the backpack adapter (10) so that in use, the backpack adapter (10) looks like a J when seen sideways or alternatively, can look like a truncated T if the shoulder strap assembly (40) is fastened to the coupling means (24, 26) closer to the other end.

Furthermore, although four coupling means (20, 22, 24, 26) are shown, more coupling means could be provided on the user side (14) of the backpack adapter (10) in order to more easily adjust lengthwise both the shoulder strap assembly (40) and waist strap assembly (42).

Figure 3:
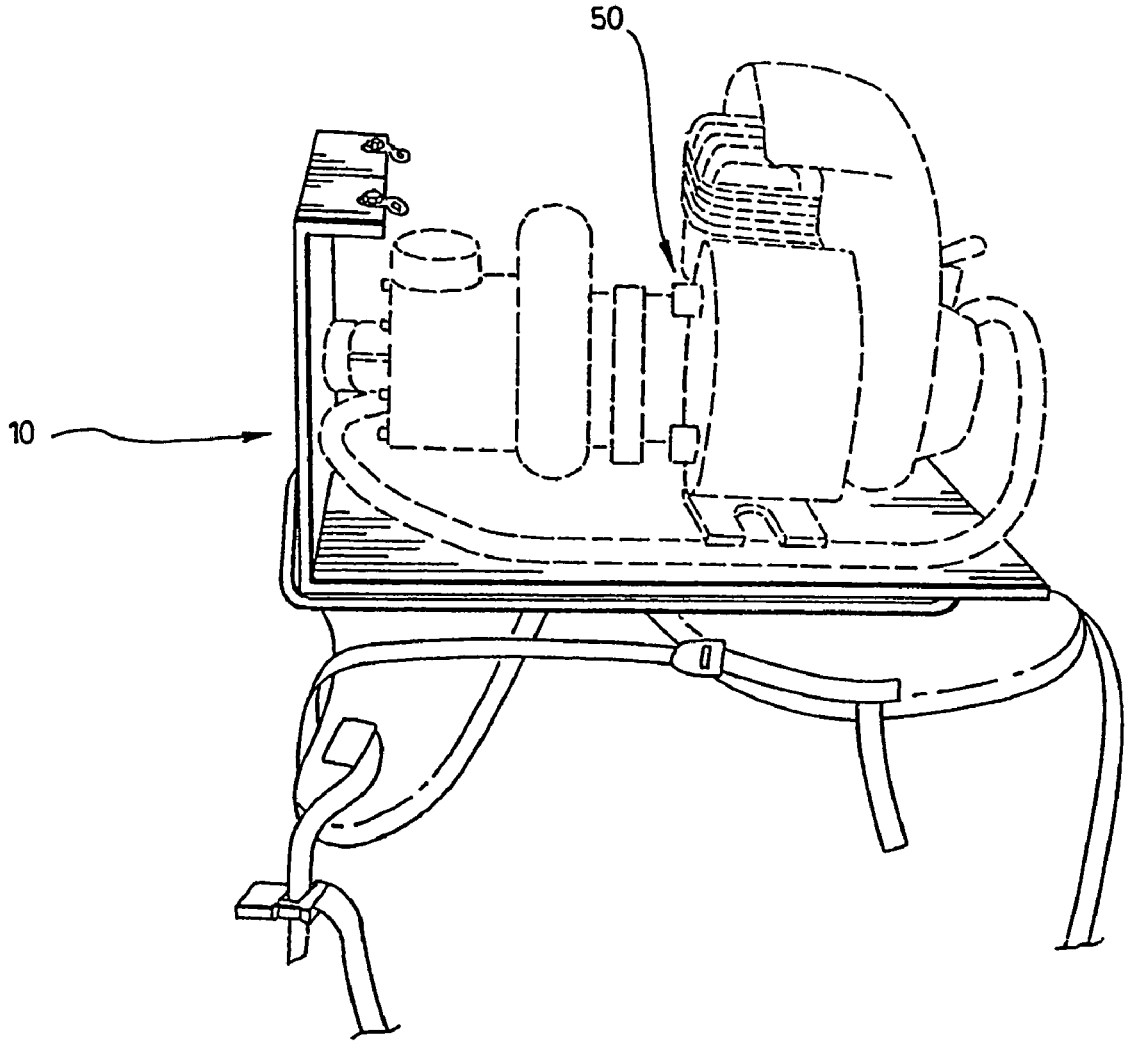
FIG. 3 is a schematic representation of the backpack adapter having a pump mounted on the load side.

In FIG. 3, there is shown a backpack adapter (10) with a pump (50) mounted on the load side (16).

Figure 4:
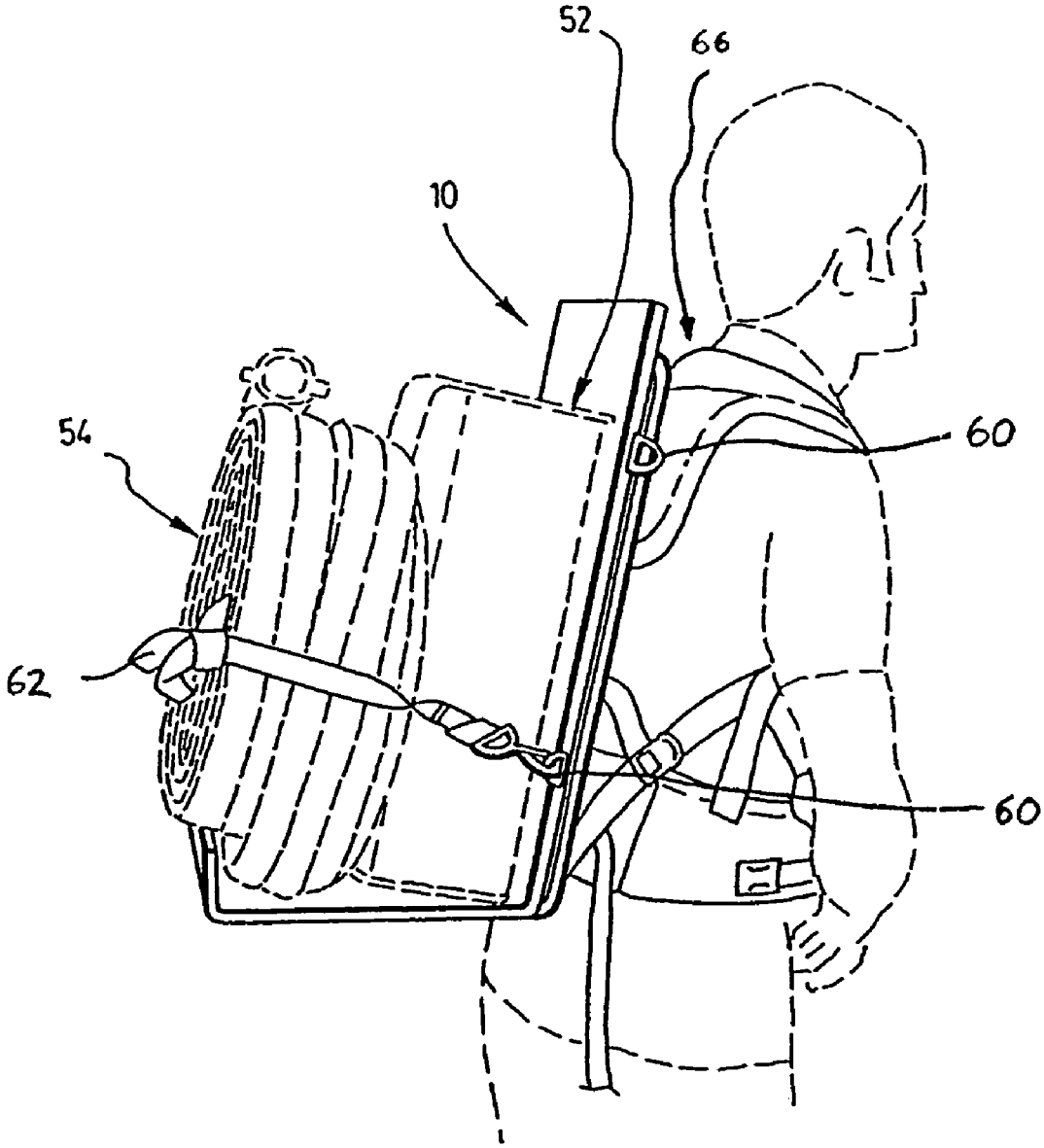
FIG. 4 is a schematic representation of the backpack adapter having a canister and a hose mounted thereon, with the bottom L portion closer to the ground.

FIG. 4 shows the same backpack adapter (10), but with a canister (52) and a hose (54) mounted thereon. Preferably, the L-shaped frame (12) comprises rings (60) serving as attach points to hold down equipment on the backpack adapter (10). Restraint straps (62) can thus be attached to the rings (60) to hold down equipment. Preferably, the rings (60) are D-shape rings.

Figure 5:
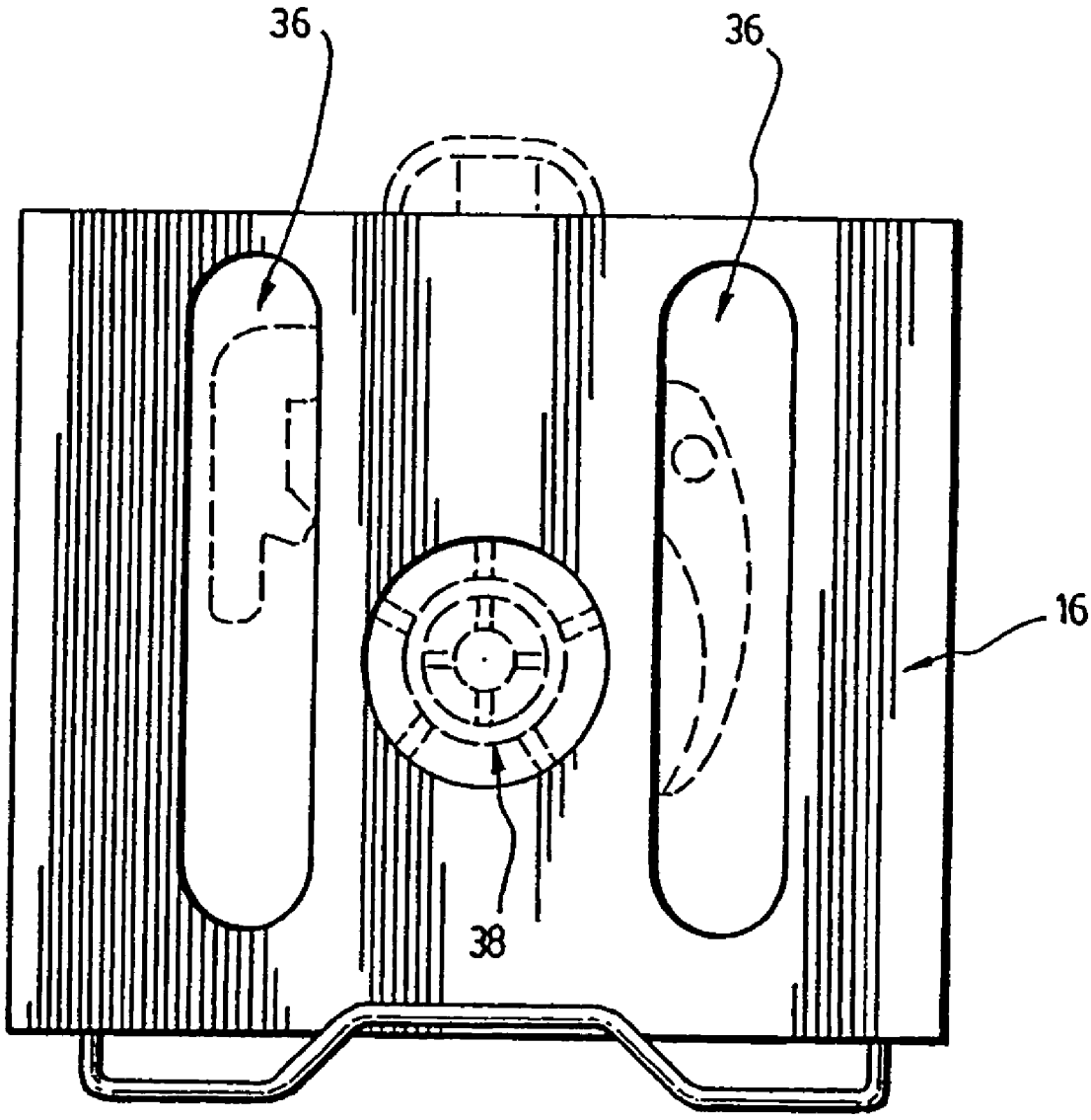
FIG. 5 is a bottom view of the backpack adapter showing two longitudinal grooves which are provided in order to permit the placement of the shovels therein as well as a hole between the two grooves for receiving a hose.

As shown in FIG. 5, the bottom L portion (16) preferably comprises two longitudinal grooves (36) as well as a hole (38) between the two grooves (36).

Figure 6:
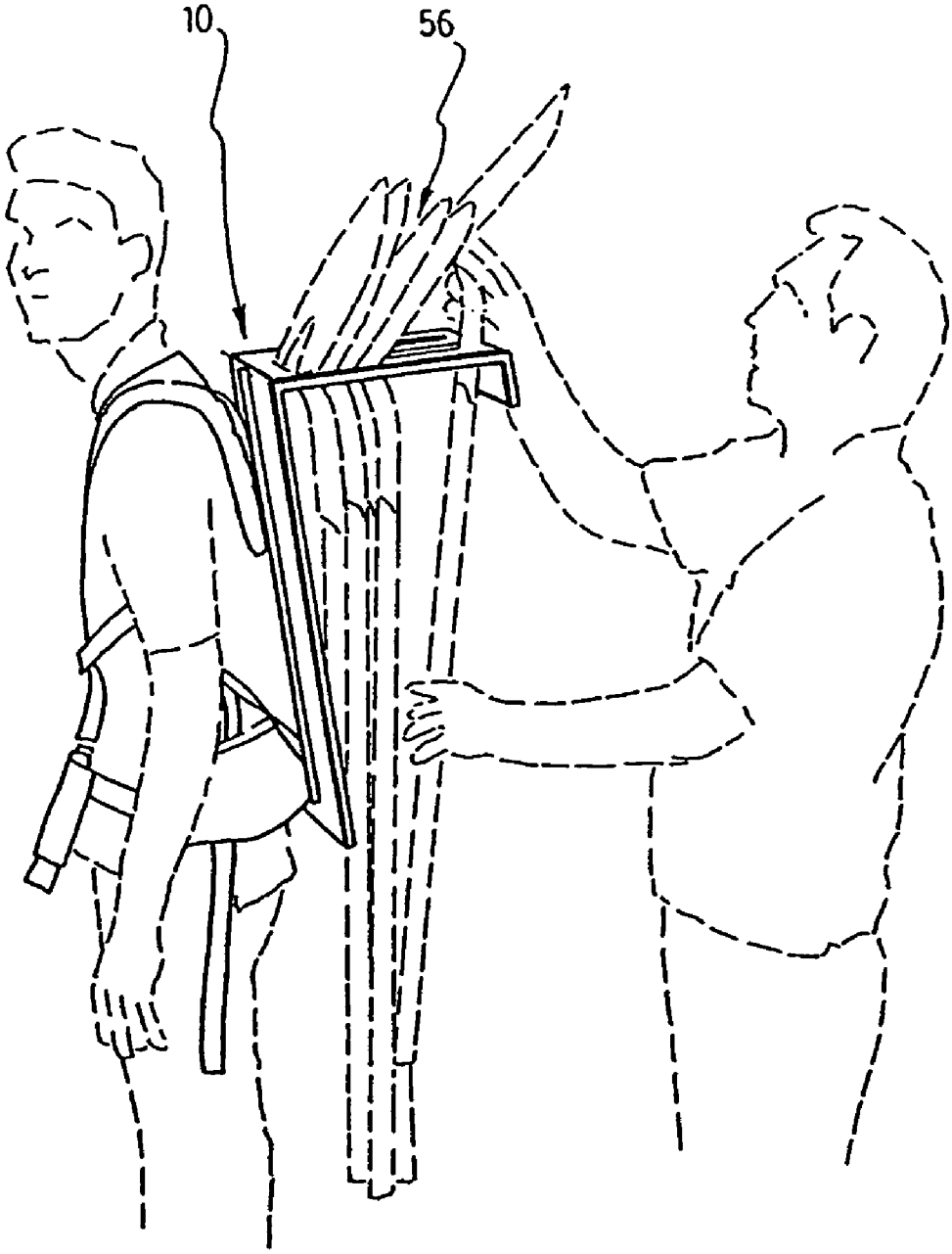
FIG. 6 is a schematic representation of the backpack adapter where the bottom L portion is reversed with respect to the configuration shown in FIG. 4. In such a configuration, the backpack adapter is adapted to carry shovels as shown in the figure.

FIG. 6 shows the backpack adapter (10) in its "reversed" configuration so that a user could carry, for example, a plurality of shovels (56) which are inserted in the grooves (36) shown on FIG. 5. The hole (38), on the other hand, could be used to receive a hose.

Figure 7:
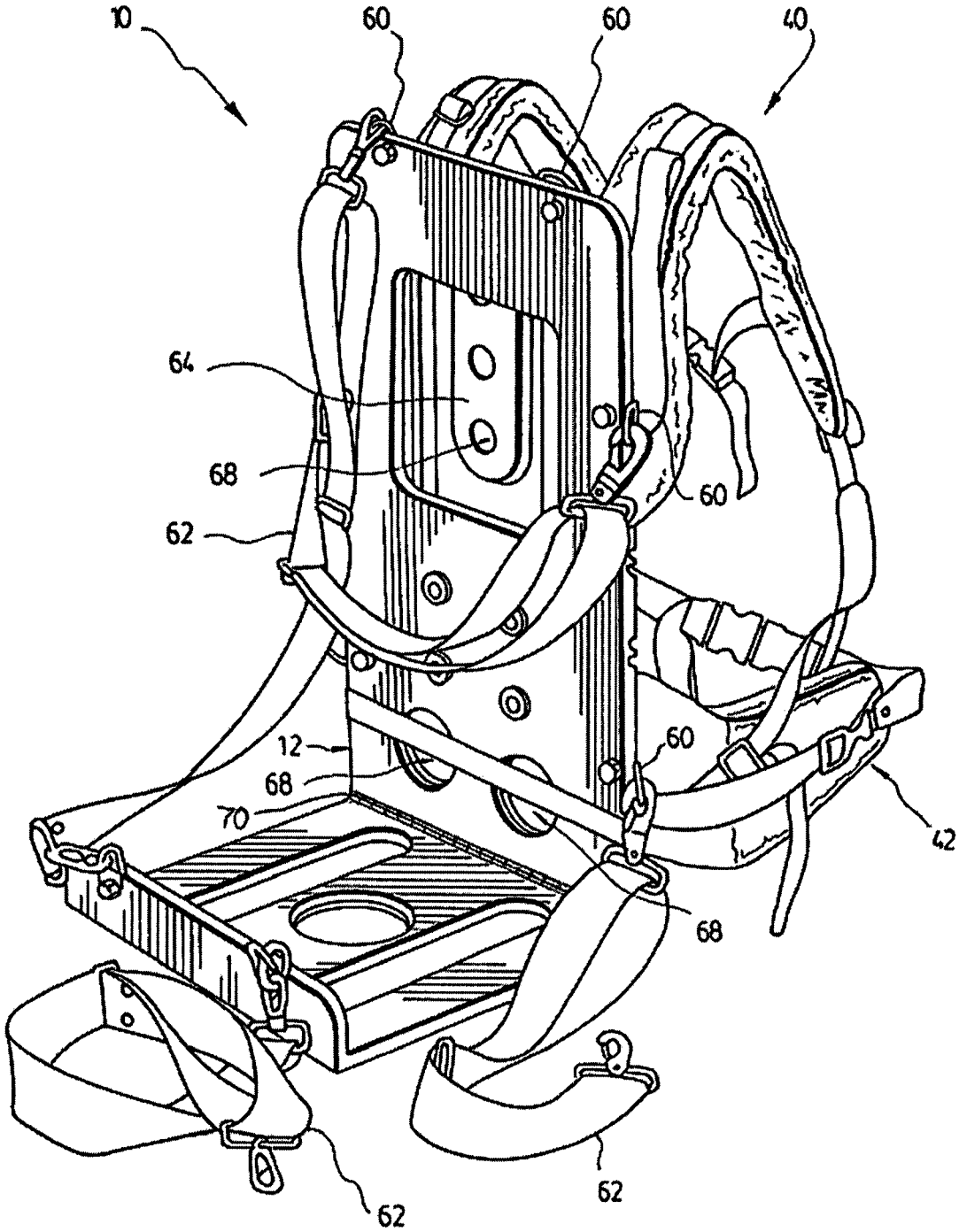
FIG. 7 is a schematic representation of a backpack adapter according to a second preferred embodiment of the invention wherein the shoulder strap means comprises a shoulder strap assembly and a backboard.

FIG. 7 shows a backpack adapter (10) according to another preferred embodiment of the invention, wherein the shoulder strap means (66) comprises a shoulder strap assembly (40) and a backboard (64). Preferably, the L-shaped frame (12) comprises different lightening holes (68) in its structure in order to reduce the overall weight of the backpack adapter (10). FIG. 7 also illustrates how different restraint straps (62) and rings (60) can be used to hold down equipment on the backpack adapter (10).

In another preferred embodiment of the invention, the bottom L portion can move with respect to the top L portion. This can be accomplished through a hinged interface (70) between the two portions, among other things, as shown in FIG. 7. Consequently, the bottom L portion could have different or alternate configurations such as a compact or collapsed configuration for stowage and a deployed configuration for use. In another preferred embodiment of the invention, the bottom L portion could be completely removed from the top L portion.

It will, of course, be appreciated that a variety of different loads can be carried and that the backpack adapter can be adapted to persons of various heights comfortably and securely.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. In a backpack adapter comprising at least one shoulder strap with at least one shoulder strap connector and a generally L-shaped structure having a top L portion and a bottom L portion, the top L portion having an upper portion with at least one first connector and a lower portion with at least one second connector, a method for configuring the backpack adapter comprising:

coupling, in a first configuration, the at least one shoulder strap connector to at least one of the at least one first connector so that the shoulder strap is connected to the upper portion of the L-shaped structure in order to have the L-shaped structure positioned to generally resemble a right-side-up "L";

removing the coupling of the at least one shoulder strap connector to the at least one of the at least one first connector;

coupling, in a second configuration, the at least one shoulder strap connector to at least one of the at least one second connector so that the shoulder strap is connected to the lower portion of the L-shaped structure to reversibly have the L-shaped structure positioned to generally resemble an upside down "L"; and wearing the backpack adapter in the second configuration with the L-shaped structure positioned to generally resemble an upside-down "L".

2. The method for configuring the backpack adapter of claim 1, wherein the bottom L portion of the L-shaped structure has a flange extending at an angle therefrom;

wherein a first cargo is connected to the flange in the first configuration in order to secure the first cargo to the L-shaped structure; and wherein a second cargo is not connected to the flange in the second configuration.

3. The method for configuring the backpack adapter of claim 1, wherein the backpack adapter further comprises a waist strap with at least one waist strap connector; and further comprising:

connecting, in the first configuration, the at least one waist strap connector to the lower portion of the top L-portion of the L-shaped structure, and connecting, in the second configuration, the at least one waist strap connector to the upper portion of the top L portion of the L-shaped structure.

4. The method for configuring the backpack adapter of claim 3, wherein, in the first configuration, the at least one waist strap connector connects to the second connector; and wherein, in the second configuration, the at least one waist strap connector connects to the first connector.

5. The method for configuring the backpack adapter of claim 1, wherein the L-shaped structure includes at least one cargo connector for cargo to connect to the backpack; and further comprising coupling cargo to the at least one cargo connector in the second configuration differently from cargo in the first configuration.

6. The method for configuring the backpack adapter of claim 5, wherein the at least one cargo connector connects a first cargo in the first configuration differently from a second cargo in the second configuration.

7. The method for configuring the backpack adapter of claim 6, wherein the bottom L portion has a first surface and a second surface, the first surface being opposite the second surface;

wherein in the first configuration, the first cargo contacts the first surface; and wherein in the second configuration, the second cargo contacts the second surface.

8. The method for configuring the backpack adapter of claim 7, wherein in the first configuration, the first surface of the bottom L portion faces upward and the second surface of the bottom L portion faces downward;

wherein in the second configuration, the second surface of the bottom L portion faces upward and the first surface of the bottom L portion faces downward;

wherein weight of the first cargo in the first configuration exerts a first force to push on the first surface; and wherein weight of the second cargo in the second configuration exerts a second force to push on the second surface.

* * * * *